United States Patent [19]

Gray

[11] 4,448,705

[45] May 15, 1984

[54] MONOPEROXYPHTHALIC ACID BLEACHING COMPOSITION CONTAINING DTPMP

[75] Inventor: Frederick W. Gray, Summit, N.J.

[73] Assignee: Colgate-Palmolive Company, New York, N.Y.

[21] Appl. No.: 379,824

[22] Filed: May 20, 1982

[51] Int. Cl.[3] ..... C11D 3/30; C11D 3/36; C11D 3/39; D06L 3/02

[52] U.S. Cl. ..... 252/102; 252/95; 252/99; 252/174.16; 252/186.26; 252/186.42; 252/545

[58] Field of Search ..... 252/95, 99, 102, 174.16, 252/186.26, 186.42, 545, DIG. 11

[56] References Cited

U.S. PATENT DOCUMENTS

| | | | |
|---|---|---|---|
| 3,243,378 | 3/1966 | Stolz | 252/99 |
| 3,740,581 | 6/1973 | Kowalski | 8/111 |
| 4,005,029 | 1/1977 | Jones | 252/99 |
| 4,013,581 | 3/1977 | Huber | 252/186.26 |
| 4,170,453 | 10/1979 | Kitco | 8/111 |
| 4,225,452 | 9/1980 | Leigh | 252/102 |
| 4,259,201 | 3/1981 | Cockrell | 252/103 |
| 4,325,828 | 4/1982 | Postlethwaite | 252/102 |
| 4,337,164 | 6/1982 | Clements | 252/96 |

FOREIGN PATENT DOCUMENTS

| | | |
|---|---|---|
| 27693 | 4/1981 | European Pat. Off. . |
| 37146 | 10/1981 | European Pat. Off. . |

*Primary Examiner*—Dennis L. Albrecht

*Attorney, Agent, or Firm*—Bernard Lieberman; Herbert S. Sylvester; Murray M. Grill

[57] ABSTRACT

An improved bleaching and laundering composition is provided comprising monoperoxyphthalic acid and/or a water-soluble salt thereof and a chelating agent capable of forming a substantially water-soluble complex with metal ion in aqueous solution. A method of bleaching and laundering soiled and/or stained materials with the aforesaid bleaching composition is also described. A preferred chelating agent is diethylene triamine pentamethylene phosphonic acid (DTPMP) and/or a water-soluble salt thereof.

16 Claims, No Drawings

MONOPEROXYPHTHALIC ACID BLEACHING COMPOSITION CONTAINING DTPMP

CROSS REFERENCE TO RELATED APPLICATION

This application is related to copending U.S. application Ser. No. 379,825, filed on even date herewith, which describes a bleaching and laundering composition comprising monoperoxyphthalic acid and/or a water-soluble salt thereof, a peroxygen compound, an activator comprising phthalic anhydride and a chelating agent.

BACKGROUND OF THE INVENTION

This invention relates, in general, to bleaching and laundering compositions and their application to laundering operations. More specifically, this invention relates to bleaching and laundering compositions containing monoperoxyphthalic acid and/or a water-soluble salt thereof in combination with a chelating agent capable of forming a water-soluble metal complex in aqueous solution.

Bleaching compositions which release active oxygen in the laundry solution are extensively described in the prior art and commonly used in laundering operations. In general, such bleaching compositions contain peroxygen compounds, such as, perborates, percarbonates, perphosphates and the like which promote the bleaching activity by forming hydrogen peroxide in aqueous solution. A major drawback attendant to the use of such peroxygen compounds is that they are optimally effective at the relatively low washing temperatures employed in most household washing machines in the United States, i.e., temperatures in the range of 80° to 130° F. By way of comparison, European wash temperatures are generally substantially higher extending over a range, typically, from 90° to 200° F. However, even in Europe and those other countries which generally presently employ near boiling washing temperatures, there is a trend towards lower temperature laundering.

In an effort to enhance the bleaching activity of peroxygen bleaches, the prior art has employed materials called activators in combination with the peroxygen compounds. It is generally believed that the interaction of the peroxygen compound and the activator results in the formation of a peroxyacid which is the active species for bleaching. Numerous compounds have been proposed in the art as activators for peroxygen bleaches among which are included carboxylic acid anhydrides such as those disclosed in U.S. Pat. Nos. 3,928,775; 3,338,839; and 3,352,634; carboxylic esters such as disclosed in U.S. Pat. No. 2,995,905; N-acyl compounds such as those described in U.S. Pat. Nos. 3,912,648 and 3,919,102; cyanomines such as described in U.S. Pat. No. 4,199,466; and acyl sulfoamides such as disclosed in U.S. Pat. No. 3,245,913.

Pre-formed peroxyacids have also been used to effect bleaching in laundry wash solutions. U.S. Pat. Nos. 3,770,816; 4,170,453; and 4,259,201 are illustrative of prior art disclosures relating to bleaching compositions comprising a peroxyacid compound.

It is generally recognized in the art that metal ions are capable of acting as decomposition catalysts for inorganic peroxygen compounds and organic peroxyacids. In an effort to stabilize such bleaching species in the wash solution, chelating agents have been incorporated into bleaching detergent compositions. U.S. Pat. No. 3,243,378 to Stoltz, for example, discloses a bleaching composition containing a peroxygen bleaching compound and a chelating agent to sequester metal cations. In general, the chelating agents which have been used for this purpose fall into one of two categories: (a) materials such as heterocyclics compounds and ketones, notably 8-hydroxyquinoline, which tie up metal cations in the laundry wash by precipitating them from solution; and (b) materials such as aminopolycarboxylates and aminopolyphosphonate compounds which form water-soluble metal complexes with the cations present in the wash solution. Accordingly, U.S. Pat. No. 4,005,029 discloses that selected aldehydes, ketones and compounds which yield aldehydes or ketones in aqueous solution (e.g., 8-hydroxyquinoline) can be used to activate aliphatic peroxyacids, such as, diperazelaic acid, diperadipic acid and aromatic peroxyacids (and water-soluble salts thereof) including monoperoxyphthalic acid and diperoxyterephthalic acid. In U.S. Pat. No. 4,170,453, a mixture of 8-hydroxyquinoline, phosphoric acid and sodium pyrophosphate is disclosed as a preferred chelating system to stabilize the active oxygen generated in wash solutions containing diperoxydodecandioic acid, U.S. Pat. No. 4,225,452 to Leigh discloses the combination of specified classes of chelating agents (among which are phosphonate compounds) with inorganic peroxygen compounds and an organic activator for the purpose of suppressing the decomposition of the peroxygen compound in the bleach composition. Specifically, the chelating agent is said to inhibit the unwanted side reaction of the peroxygen compound with the peroxyacid formed by the primary reaction of the peroxygen compound and the activator, the effect of the side reaction being to deplete the peroxyacid bleaching species from solution. The Leigh patent, however, discourages the use of such chelating agents in solutions wherein the peroxyacid has a double bond between the carbon atoms in the $\alpha,\alpha'$ position to the carbonyl group. Specifically, at column 2 of the patent, beginning at line 63, the patentee excludes phthalic anhydride as an activator for the disclosed bleaching composition because of instability. Inasmuch as the peroxyacid formed by the reaction of phthalic anhydride and an inorganic peroxygen compound is monoperoxyphthalic acid, the Leigh patent apparently discourages the use of monoperoxyphthalic acid in the bleaching compositions of the patent.

European Patent Publication No. 0,027,693, published Apr. 29, 1981, discloses the use of magnesium monoperoxyphthalate as an effective bleaching agent. There is also disclosed the optional combination of a bleaching agent with an "aldehyde or ketone peroxyacid activator as described in U.S. Pat. No. 4,005,029, e.g., 8-hydroxyquinoline which is a known peroxygen stabilizer". The Publication also discloses organic phosphonate compounds, along with a wide variety of other compounds, as being useful detergent builders which optionally may be included in the described washing compositions. No disclosure is made, however, concerning the beneficial effects attendant to the use of a small amount of organic phosphonate compounds to serve as chelating agents in bleaching compositions and particularly, in compositions containing magnesium monoperoxyphthalate.

Thus, while the art has concerned itself with improving the stability of peroxygen and peroxyacid bleaching compounds with the use of chelating agents, it has heretofore failed to disclose or suggest the specific combination of peroxyacid compounds with chelating agents of the type which form substantially water-soluble compounds or complexes with metal cations in the aqueous wash solution, the use of such type chelating agents being solely disclosed in combination with peroxygen compounds used alone or in combination with activators. Moreover, the beneficial effect attendant to the combination of such chelating agents with monoperoxyphthalic acid and/or a water-soluble salt thereof, in particular, is unappreciated in the prior art.

SUMMARY OF THE INVENTION

The present invention provides a bleaching composition comprising monoperoxyphthalic acid (also referred to herein as "MPPA" for purposes of convenience) and/or a water-soluble salt thereof and a chelating agent capable of forming a substantially water-soluble compound or complex with metal ion in aqueous solution.

The bleaching detergent composition of the invention comprises the above-defined bleaching composition in combination with a surface active detergent and one or more detergent builder salts. In accordance with the process of the invention, bleaching of stained and/or soiled materials is effected by contacting such materials with an aqueous solution of the above-defined compositions.

The term "chelating agent" as used herein refers to organic compounds which, in small amounts, are capable of binding transition metal cations, (e.g., iron, nickel and cobalt) which are known to adversely affect the stability of peroxygen compounds and/or peroxyacids in aqueous bleaching solutions. The chelating agents employed herein therefore exclude inorganic compounds ordinarily used in detergent formulations as builder salts. The chelating agents useful for the present invention are of the type capable of forming a substantially water-soluble, rather than a precipitated, metal complex in aqueous solutions with metal ions, most notably, transition metal cations such as those referred to above. Suitable chelating agents therefore include ethylene diamine tetraacetic acid (EDTA); nitrilotriacetic acid (NTA); diethylene triamine pentaacetic acid; ethylene diamine tetramethylene phosphonic acid (EDITEMPA); amino trimethylene phosphonic acid (ATMP); diethylene triamine pentacetic acid (DETPA), all of the above-mentioned compounds being preferably employed in the form of the sodium salt. In contrast thereto, chelating agents, such as, 8-hydroxyquinoline, which form a precipitated metal complex in aqueous solution are excluded from the present invention.

A preferred class of chelating agents are the organic phosphonate compounds such as those disclosed in U.S. Pat. No. 4,225,452, the formulae of which are set forth in Equations I, II and III in columns 3 and 4 of the patent. Among this class of materials diethylene triamine pentamethylene phosphonic acid (referred to herein as "DTPMP"), and/or a water-soluble salt thereof is particularly preferred as a chelating agent for purposes of the present invention. Among the salts of DTPMP, the sodium, potassium and ammonium salts are generally preferred because of their relatively greater solubility and ease of preparation.

In general, the chelating agents employed in the bleaching compositions of the invention are present in a weight ratio relative to MPPA and/or its salts of from about 1:5 to about 1:50, and more preferably, from about 1:7 to about 1:20. In the built bleaching detergent compositions of the invention, the concentration of chelating agent is generally below about 5%, by weight, preferably below about 2%, by weight, and most preferably below about 1%, by weight, of such detergent compositions. The chelating agents may be utilized alone or in combination with one or more other chelating agents. Thus, for example, DTPMP may be advantageously employed in combination with EDTA in the compositions of the invention.

DETAILED DESCRIPTION OF THE INVENTION

Monoperoxyphthalic acid and/or one or more of its water-soluble salts are the primary bleaching agents in the bleaching compositions of the invention. Although MPPA provides acceptable bleaching activity, it has the disadvantage of relatively poor stability when stored in admixture with other components ordinarily present in household detergent compositions. Hence, for purposes of stability, the magnesium salt of MPPA is preferably employed in the compositions of the invention, namely, magnesium monoperoxyphthalate. A preferred bleaching composition thus comprises about 65 wt.% magnesium monoperoxyphthalate, about 11 wt.% magnesium phthalate, and the balance water and a sequestering agent. The active oxygen content of this bleaching composition is about 5 to 6%. The alkali metal, calcium or barium alkaline earth and/or ammonium salts of MPPA may also be employed in the bleaching and laundering compositions of the invention, although such salts are generally less preferred from the standpoint of stability than the aforementioned magnesium salt.

The production of MPPA is generally effected by the reaction of hydrogen peroxide and phthalic anhydride. The resultant MPPA can then be used to produce magnesium monoperoxyphthalate by reaction with a magnesium compound in the presence of an organic solvent. A detailed description of the product of MPPA and its magnesium salt is set forth on pages 7 to 10, inclusive, of European Patent Publication No. 0,027,693, published April 29, 1981, the aforementioned pages 7 to 10 being incorporated herein by reference.

The MPPA bleaching agent (or a salt thereof) may optionally be combined in the present bleaching compositions with a conventional peroxygen bleach compound and an activator therefor. Examples of suitable peroxygen compounds include alkali metal perborates, percarbonates, perphosphates and the like, sodium perborate being particularly preferred because of its commercial availability. Conventional activators such as those disclosed, for example, at column 4 of the U.S. Pat. No. 4,259,200 are suitable for use in conjunction with such peroxygen compound. The polyacylated amines are generally of special interest, TAED in particular being a preferred activator. Other suitable activators include anhydride compounds, such as, benzoic, maleic, succinic and phthalic; and acyl compounds such as N-acetyl and N-benzoyl-imidazoles. The use of MPPA in combination with a peroxygen compound activated with phthalic anhydride is a particularly preferred bleaching composition described in the aforementioned copending U.S. Application Ser. No. 379,825, filed on even date herewith. In general, the molar ratios of peroxygen compound to activator can vary widely depending upon the particular choice of peroxygen compound and activator. However, molar ratios of from about 0.5:1 to about 25:1 are generally suitable for providing satisfactory bleaching performance.

In accordance with another embodiment of the invention, the bleaching agent employed in the bleaching composition described herein is devoid of a peroxygen compound and is solely comprised of MPPA and/or its water-soluble salts. In general, such bleaching compositions are most effective at the relatively low washing temperatures employed in typical household washing machines in the United States.

The amount of bleaching composition added to the wash solution is generally selected to provide an amount of peroxyacid compound within the range corresponding to about 3 to 100 parts of active oxygen per million parts of the wash solution.

MPPA and/or its water-soluble salt in combination with a chelating agent may be formulated as a separate bleach product, or alternatively may be employed in a built detergent composition. Accordingly, the bleaching composition of the invention may include conventional additives used in the fabric washing art, such as, binders, fillers, builder salts, proteolytic enzymes, optical brighteners, perfumes, dyes, corrosion inhibitors, anti-redeposition agents, foam stabilizers and the like, all of which may be added in varying quantities depending on the desired properties of the bleaching composition and their compatability with such composition. Additionally, the bleaching compositions of the invention may be incorporated into laundering detergent compositions containing one or more surface active agents selected from the group consisting of anionic, cationic, nonionic, ampholytic and zwitterionic detergents.

When the instant bleaching compositions are incorporated into a conventional laundering composition and are thus provided as a fully formulated bleaching detergent composition, the latter compositions will comprise the following: from about 5 to 50%, by weight, of the instant bleaching composition; from about 5 to 50%, by weight, of a detergent surface active agent, preferably from about 5 to 30% by weight; and from about 5 to 80%, by weight, of a detergent builder salt which can also function as a buffer to provide the requisite pH range when the laundering composition is added to water. The aqueous wash solutions will have a pH range of from about 7 to 12, preferably from about 8 to 10, and most preferably from about 8.5 to 9. A preferred amount of the builder salt is from about 20% to about 65%, by weight of the composition. The balance of the composition will predominantly comprise water, filler salts, such as, sodium sulfate, and optionally, minor additives, such as, optical brighteners, perfumes, dyes, anti-redeposition agents and the like.

Among the anionic surface active agents useful in the present invention are those surface active or detergent compounds which contain an organic hydrophobic group containing generally from about 8 to 26 carbon atoms and preferably 10 to 18 carbon atoms in their molecular structure and at least one water-solubilizing group selected from the groups of sulfonate, sulfate, carboxylate, phosphonate and phosphate so as to form a water-soluble detergent.

Examples of suitable anionic detergents include soaps, such as, the water-soluble salts (e.g., the sodium, potassium, ammonium and alkanolammonium salts) of higher fatty acids or resin salts containing from about 8 to 20 carbon atoms and preferably 10 to 18 carbon atoms. Suitable fatty acids can be obtained from oils and waxes of animal or vegetable origin, for example, tallow, grease, coconut oil and mixtures thereof. Particularly useful are the sodium and potassium salts of the fatty acid mixtures derived from coconut oil and tallow, for example, sodium coconut soap and potassium tallow soap.

The anionic class of detergents also includes the water-soluble sulfated and sulfonated detergents having an alkyl radical containing from about 8 to 26, and preferably from about 12 to 22 carbon atoms. Examples of the sulfonated anionic detergents are the higher alkyl mononuclear aromatic sulfonates such as the higher alkyl benzene sulfonates containing from about 10 to 16 carbon atoms in the higher alkyl group in a straight or branched chain, such as, for example, the sodium, potassium and ammonium salts of higher alkyl benzene sulfonates, higher alkyl toluene sulfonates and higher alkyl phenol sulfonates.

Other suitable anionic detergents are the olefin sulfonates including long chain alkene sulfonates, long chain hydroxyalkane sulfonates or mixtures of alkene sulfonates and hydroxyalkane sulfonates. The olefin sulfonate detergents may be prepared in a conventional manner by the reaction of $SO_3$ with long chain olefins containing from about 8 to 25, and preferably from about 12 to 21 carbon atoms, such olefins having the formula $RCH{=}CHR_1$ wherein R is a higher alkyl group of 6 to 23 carbons and $R_1$ is an alkyl group containing from about 1 to 17 carbon atoms or hydrogen to form a mixture of sultones and alkene sulfonic acids which is then treated to convert the sultones to sulfonates. Other examples of sulfate or sulfonate detergents are paraffin sulfonates containing from about 10 to 20 carbon atoms, and preferably from about 15 to 20 carbon atoms. The primary paraffin sulfonates are made by reacting long chain alpha olefins and bisulfites. Paraffin sulfonates having the sulfonate group distributed along the paraffin chain are shown in U.S. Pat. Nos. 2,503,280; 2,507,088; 3,260,741; 3,372,188 and German Pat. No. 735,096. Other useful sulfate and sulfonate detergents include sodium and potassium sulfates of higher alcohols containing from about 8 to 18 carbon atoms, such as, for example, sodium lauryl sulfate and sodium tallow alcohol sulfate, sodium and potassium salts of alpha-sulfofatty acid esters containing about 10 to 20 carbon atoms in the acyl group, for example, methyl alpha-sulfomyristate and methyl alphasulfotallowate, ammonium sulfates of mono- or di-glycerides of higher ($C_{10}$–$C_{18}$) fatty acids, for example, stearic monoglyceride monosulfate; sodium and alkylol ammonium salts of alkyl polyethenoxy ether sulfates produced by condensing 1 to 5 moles of ethylene oxide with 1 mole of higher ($C_8$–$C_{18}$) alcohol; sodium higher alkyl ($C_{10}$–$C_{18}$) glyceryl ether sulfonates; and sodium or potassium alkyl phenol polyethenoxy ether sulfates with about 1 to 6 oxyethylene groups per molecule and in which the alkyl radicals contain about 8 to 12 atoms.

The most highly preferred water-soluble anionic detergent compounds are the ammonium and substituted ammonium (such as mono, di and tri-ethanolamine), alkali metal (such as, sodium and potassium) and alkaline earth metal (such as, calcium and magnesium) salts of the higher alkyl benzene sulfonates, olefin sulfonates and higher alkyl sulfates. Among the above-listed anionics, the most preferred are the sodium linear alkyl benzene sulfonates (LABS).

The nonionic synthetic organic detergents are characterized by the presence of an organic hydrophobic group and an organic hydrophilic group and are typically produced by the condensation of an organic alphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxyethylene chain can be readily adjusted to achieve the desired balance between the hydrophobic and hydrophilic groups.

The nonionic detergents include the polyethylene oxide condensate of 1 mole of alkyl phenol containing from about 6 to 12 carbon atoms in a straight or branched chain configuration with about 5 to 30 moles of ethylene oxide, for example, nonyl phenol condensed with 9 moles of ethylene oxide; dodecyl phenol condensed with 15 moles of ethylene oxide; and dinonyl phenol condensed with 15 moles of ethylene oxide. Condensation products of the corresponding alkyl thiophenols with 5 to 30 moles of ethylene oxide are also suitable.

Of the above-described types of nonionic surfactants, those of the ethoxylated alcohol type are preferred. Particularly preferred nonionic surfactants include the condensation product of coconut fatty alcohol with about 6 moles of ethylene oxide per mole of coconut fatty alcohol, the condensation product of tallow fatty alcohol with about 11 moles of ethylene oxide per mole of tallow fatty alcohol, the condensation product of a secondary fatty alcohol containing about 11–15 carbon atoms with about 9 moles of ethylene oxide per mole of fatty alcohol and condensation products of more or less branched primary alcohols, whose branching is predominantly 2-methyl, with from about 4 to 12 moles of ethylene oxide.

Zwitterionic detergents such as the betaines and sulfobetaines having the following formula are also useful:

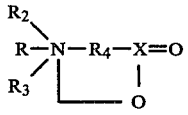

wherein R is an alkyl group containing from about 8 to 18 carbon atoms, $R_2$ and $R_3$ are each an alkylene or hydroxyalkylene group containing about 1 to 4 carbon atoms, $R_4$ is an alkylene or hydroxyalkylene group containing 1 to 4 carbon atoms, and X is C or S:O. The alkyl group can contain one or more intermediate linkages such as amido, ether, or polyether linkages or nonfunctional substituents such as hydroxyl or halogen which do not substantially affect the hydrophobic character of the group. When X is C, the detergent is called a betaine; and when X is S:O, the detergent is called a sulfobetaine or sultaine.

Cationic surface active agents may also be employed. They comprise surface active detergent compounds which contain an organic hydrophobic group which forms part of a cation when the compound is dissolved in water, and an anionic group. Typical cationic surface active agents are amine and quaternary ammonium compounds.

Examples of suitable synthetic cationic detergents include: normal primary amines of the formula $RNH_2$ wherein R is an alkyl group containing from about 12 to 15 atoms; diamines having the formula $RNHC_2H_4NH_2$ wherein R is an alkyl group containing from about 12 to 22 carbon atoms, such as N-2-aminoethyl-stearyl amine and N-2-aminoethyl myristyl amine; amide-linked amines, such as those having the formula $R_1CONHC_2H_4NH_2$ wherein $R_1$ is an alkyl group containing about 8 to 20 carbon atoms, such as N-2-amino ethylstearyl amide and N-amino ethylmyristyl amide; quaternary ammonium compounds wherein typically one of the groups linked to the nitrogen atom is an alkyl group containing about 8 to 22 carbon atoms and three of the groups linked to the nitrogen atom are alkyl groups which contain 1 to 3 carbon atoms, including alkyl groups bearing inert substituents, such as phenyl groups, and there is present an anion such as halogen, acetate, methosulfate, etc. The alkyl group may contain intermediate linkages such as amide which do not substantially affect the hydrophobic character of the group, for example, stearyl amido propyl quaternary ammonium chloride. Typical quaternary ammonium detergents are ethyl-dimethyl-stearyl-ammonium chloride, benzyl-dimethyl-stearyl ammonium chloride, trimethyl-stearyl ammonium chloride, trimethyl-cetyl ammonium bromide, dimethylethyl-lauryl ammonium chloride, dimethyl-propyl-myristyl ammonium chloride, and the corresponding methosulfates and acetates.

Ampholytic detergents are also suitable for the invention. Ampholytic detergents are well known in the art and many operable detergents of this class are disclosed by A. M. Schwartz, J. W. Perry and J. Birch in "Surface Active Agents and Detergents," Interscience Publishers, New York, 1958, vol. 2. Examples of suitable amphoteric detergents include: alkyl betaiminodipropionates, $RN(C_2H_4COOM)_2$; alkyl beta-amino propionates, $RN(H)C_2H_4COOM$; and long chain imidazole derivatives having the general formula:

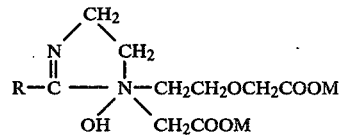

wherein in each of the above formulae R is an acyclic hydrophobic group containing from about 8 to 18 carbon atoms and M is a cation to neutralize the charge of the anion. Specific operable amphoteric detergents include the disodium salt of undecylcycloimidiniumethoxyethionic acid-2-ethionic acid, dodecyl beta alanine, and the inner salt of 2-trimethylamino lauric acid.

The laundry detergent composition of the invention optionally contain a detergent builder of the type commonly used in detergent formulations. Useful builders include any of the conventional inorganic water-soluble builder salts, such as, for example, water-soluble salts of phosphates, pyrophosphates, orthophosphates, polyphosphates, silicates, carbonates, and the like. Organic builders include water-soluble phosphonates, polyphosphonates, polyhydroxysulfonates, polyacetates, carboxylates, polycarboxylates, succinates and the like.

Specific examples of inorganic phosphate builders include sodium and potassium tripolyphosphates, pyrophosphates and hexametaphosphates. The organic polyphosphonates specifically include, for example, the sodium and potassium salts of ethane 1-hydroxy-1, 1-diphosphonic acid and the sodium and potassium salts of ethane-1, 1, 2-triphosphonic acid. Examples of these and other phosphorous builder compounds are disclosed in U.S. Pat. Nos. 3,213,030; 3,422,021; 3,422,137 and 3,400,176. Pentasodium tripolyphosphate and tetrasodium pyrophosphate are especially preferred water-soluble inorganic builders.

Specific examples of non-phosphorous inorganic builders include water-soluble inorganic carbonate, bicarbonate and silicate salts. The alkali metal, for example, sodium and potassium, carbonates, bicarbonates and silicates are particularly useful herein.

Water-soluble organic builders are also useful. For example, the alkali metal, ammonium and substituted ammonium polyacetates, carboxylates, polycarboxylates and polyhydroxysulfonates are useful builders for the compositions and processes of the invention. Specific examples of polyacetate and polycarboxylate builders include sodium, potassium, lithium, ammonium and substituted ammonium salts of ethylene diaminetetracetic acid, nitrilotriacetic acid, benzene polycarboxylic (i.e. penta- and tetra-) acids, carboxymethoxysuccinic acid and citric acid.

Water-insoluble builders may also be used, particularly, the complex silicates and more particularly, the complex sodium alumino silicates such as, zeolites, e.g., zeolite 4 A, a type of zeolite molecule wherein the univalent cation is sodium and the pore size is about 4 Angstroms. The preparation of such type zeolite is described in U.S. Pat. No. 3,114,603. The zeolites may be amorphous or crystalline and have water of hydration as known in the art.

An inert, water-soluble filler salt is desirably included in the laundering compositions of the invention. A preferred filler salt is an alkali metal sulfate, such as, potassium or sodium sulfate, the latter being especially preferred.

Various adjuvants may be included in the bleaching detergent compositions of the invention. For example, colorants, e.g., pigments and dyes, anti-redeposition agents, such as, carboxymethylcellulose, optical brighteners, such as, anionic, cationic, or nonionic brighteners; foam stabilizers, such as, alkanolamides, proteolytic enzymes and the like are all well-known in the fabric washing art for use in detergent compositions.

The bleaching compositions of the invention are prepared by admixing the ingredients as hereinafter illustrated. When preparing laundering compositions containing the bleaching composition in combination with a surface active detergent compound and/or builder salts, MPPA and/or a salt thereof and the chelating agent of choice can be mixed either directly with the detergent compound, builder and the like, or the MPPA and/or its salt can be coated with a coating material to prevent premature activation of the bleaching agent. The coating process is conducted in accordance with procedures well known in the art. Suitable coating materials include compounds such as magnesium sulfate, polyvinyl alcohol, lauric acid or its salts and the like.

EXAMPLE 1

A preferred low temperature bleach product has the following composition:

| Component | Weight Percent |
|---|---|
| Sodium linear $C_{10}$–$C_{13}$ alkyl benzene sulfonate. | 5 |
| Ethoxylated $C_{11}$–$C_{18}$ alcohol (11 moles of EO per mole alcohol) | 3 |
| Soap (sodium salt of $C_{12}$–$C_{22}$ carboxylic acids) | 5 |
| Sodium silicate (1 $Na_2O$:2 $SiO_2$) | 3 |
| Pentasodium tripolyphosphate (TPP) | 40 |
| Sodium salt of diethylene triamine pentamethylene phosphonic acid (DTPMP) | 0.5 |
| Enzyme[a] | 0.4 |
| Optical brighteners | 0.2 |
| H-48[b] | 7.0 |
| Perfume | 0.18 |
| Sodium sulfate | 22 |
| Water | q.s. |

[a]A proteolytic enzyme purchased as Alcalase 2M (2 anson units/gram) or as Maxatase P.

[b]A bleaching composition sold by Interox Chemicals Limited London, England, containing about 65 wt. % magnesium monoperoxyphthalate, 11 wt. % magnesium phthalate, balance $H_2O$.

The foregoing product is produced by spray drying an aqueous slurry containing 60%, by weight of a mixture containing all of the above components except the enzyme, perfume and H-48 bleaching composition. The resultant spray dried product has a particle size in the range of 8 mesh to 150 mesh, (U.S. Sieve Series) and a moisture content of about 14%. 92.5 parts by weight of said spray dried product are mixed with 7 parts by weight of H-48 of similar mesh size, 0.3 parts by weight of enzyme and 0.18 parts by weight of perfume in a rotary drum to yield a particulate product of the foregoing composition having a moisture of approximately 13%, by weight.

The above described product is used to wash soiled fabrics in a washing machine, and good laundering and bleaching performance is obtained.

Other satisfactory products can be obtained by varying the concentrations of the following principal components in the above-described composition as follows:

| Component | Weight Percent |
|---|---|
| Alkyl benzene sulfonate | 4–12 |
| Ethoxylated alcohol | 1–6 |
| Soap | 1–10 |
| TPP or alternative builder | 15–50 |
| Enzyme | 0.1–2 |
| H-48 | 1–20 |
| DTPMP | 0.1–5 |

For highly concentrated heavy duty detergent powders, the alkyl benzene sulfonate and soap components in the above-described composition may be deleted, and the ethoxylated alcohol and TPP components may be increased to an upper limit of 20 and 75 weight percent, respectively.

EXAMPLE 2

Test Procedure

Bleaching tests were carried out on standard stained test swatches (described below) using the various bleaching and laundering compositions described in table 1 of this Example in a Tergotometer vessel manufactured by the U.S. Testing Company. The Tergotometer was maintained at a constant temperature of 120° F. and operated at 100 rpm.

Each of the test compositions described in Table 1 below was added to one liter of tap water at 120° F. having a water hardness of about 100 ppm, as calcium carbonate. The test compositions were agitated for about one minute and then a mixed fabric laod consisting of two swatches each (3"×4") of the stained fabrics described below was added to each wash receptacle. After a 15 minute wash at 120° F., the test fabrics were rinsed in 100° F. tap water and then dried. The percent stain removal was measured by taking a reflectance reading for each stained test swatch prior to and after the washing using a Gardner Color Difference Meter, and the percent stain removal (% S.R.) was calculated as follows:

$$\% S.R. = \frac{(Rd \text{ after washing}) - (Rd \text{ before washing})}{(Rd \text{ before staining}) - (Rd \text{ before washing})} \times 100$$

wherein "Rd before washing" represents the Rd value after staining.

The value of percent stain removal calculated for all five cloths were averaged for each test laundering composition. A difference greater than 2% in the average of the five stained cloths tested is considered significant.

At the end of each wash, the active oxygen content of the wash solution was determined by acidification with dilute sulfuric acid followed by treatment of the wash solution with potassium iodide and a minor amount of ammonium molybdate, and thereafter titration with standardized sodium thiosulfate using starch as the indicator.

The respective stains and test swatches were as follows:

| Stain | Test Cloth |
|---|---|
| 1. Grape | 65 Dacron - 35 Cotton |
| 2. Blueberry | Cotton |
| 3. Sulfo Dye | EMPA 115 (Cotton) |
| 4. Red Wine | EMPA 114 (Cotton) |
| 5. Coffee/Tea | Cotton |

Stained test cloths 1 and 2 are prepared by passing rolls of unsoiled fabric through a padding and drying apparatus (manufactured by Benz of Zurich, Switzerland) containing either grape or blueberry solutions at 90° F. After drying at 250° F., the fabric is cut into 3"×4" swatches. Eighty of these swatches, impregnated with the same stain, are rinsed in 17 gallons of 85° F. water in an automatic home washer. They are then dried by a passage through a Beseler Print Dryer at a machine temperature setting of 6 and a speed of 10.

Stained fabrics 3 and 4 are purchased from Testfabrics Incorporated of Middlesex, N.J., and cut into 3"×4" swatches.

Stained fabric 5 is prepared by agitating and soaking unsoiled cotton strips (18"×36") in a washing machine filled with a solution of coffee/tea (8:1 weight ratio) at 150° F. The machine is allowed to rinse-spin dry to remove the coffee/tea solution. The stained fabric is then machine washed twice with hot pyrophosphate-surfactant solution followed by two complete water wash cycles at 140° F. The strips are then dried by two passes through an Ironrite machine set at 10 and then cut into 3"×4" swatches.

A granular detergent composition (designated herein as "HDD") was prepared by conventional spray-drying and had the following approximate composition:

| Composition | Weight Percent |
|---|---|
| Sodium tridecylbenzenesulfonate | 15 |
| Ethoxylated $C_{12}$–$C_{15}$ primary alcohol (7 moles EO/mole alcohol) | 1 |
| Sodium tripolyphosphate | 33 |
| Sodium carbonate | 5 |
| Sodium silicate | 7 |
| Sodium carboxymethylcellulose | 0.5 |
| Optical brighteners | 0.2 |
| Perfume | 0.2 |
| Water | 11 |
| Sodium sulfate | balance |

Detergent compositions A–E containing HDD were formulated as set forth in Table 1.

TABLE 1

| Component | Composition A | B | C | D | E |
|---|---|---|---|---|---|
| Detergent, HDD | 4.50 g | 4.50 g | 4.50 g | 4.50 g | 4.50 g |
| H-48[1] | — | 0.49 | 0.49 | 0.49 | 0.49 |
| DTPMP[2] | — | — | 0.09 | — | — |
| EDTA[3] | — | — | — | 0.09 | — |
| NTA[4] | — | — | — | — | 0.18 |

[1]A bleaching composition containing monoperoxyphthalic acid (as magnesium salt) obtained from Interox Chemicals Houston, Texas and having an active oxygen content of 5.1%.
[2]Sodium diethylene triamine pentamethylene phosphonate obtained from P. A. Hunt Chemical Corp., Lincoln, Rhode Island.
[3]Ethylene diamine tetraacetic acid, disodium salt.
[4]Nitrilotriacetic acid, trisodium salt.

Compositions A through E were tested in accordance with the procedure described above and the results of the bleaching tests are tabulated in Table 2 which sets forth the initial and final values of the active oxygen (A.O.) in the wash solution (expressed as "initial grams" and "residual grams", respectively) and the stain removal achieved for each of the 5 stains.

TABLE 2

Comparative Bleaching Performance

| | Composition A | B | C | D | E |
|---|---|---|---|---|---|
| Initial grams (A.O. × $10^3$) | — | 25.0 | 25.0 | 25.0 | 25.0 |
| Residual grams (A.O. × $10^3$) | — | 15.9 | 18.6 | 18.5 | 15.6 |
| Grams consumed (A.O. × $10^3$) | — | 9.1 | 6.4 | 6.5 | 9.4 |
| Stain removal: | % | % | % | % | % |
| Grape | 47 | 69 | 72 | 74 | 72 |
| Blueberry | 44 | 65 | 68 | 66 | 67 |
| Sulfodye (EMPA 115) | 3 | 3 | 3 | 3 | 4 |
| Red wine (EMPA 114) | 38 | 49 | 51 | 44 | 45 |
| Coffee/Tea | 17 | 43 | 39 | 38 | 41 |
| Avg. (%) | 30 | 46 | 47 | 45 | 46 |

The results of Table 2 indicate that compositions C and D (containing chelating agents DTPMP and EDTA respectively) consume less active oxygen while providing about an equivalent level of stain removal relative to composition E containing NTA or composition B which contains no chelating agent.

What is claimed is:

1. A bleaching and laundering composition comprising monoperoxyphthalic acid (MPPA) and/or a water-soluble salt thereof and a chelating agent to enhance the bleaching efficiency of the MPPA and/or the salt thereof consisting essentially of diethylene triamine pentamethylene phosphonic acid and/or a water-soluble salt thereof, said bleaching and laundering composition being devoid of an inorganic peroxygen compound.

2. A composition in accordance with claim 1 which contains magnesium monoperoxyphthalate.

3. A composition in accordance with claim 1 wherein the weight ratio of chelating agent to monoperoxyphthalic acid and/or its salt is from about 1:5 to about 1:50.

4. A composition in accordance with claim 3 wherein said weight ratio is from about 1:7 to about 1:20.

5. A composition in accordance with claim 1 which additionally contains one or more surface active agents selected from the group consisting of anionic, cationic, nonionic, ampholytic and zwitterionic detergents.

6. A composition in accordance with claim 1 wherein the concentration of the chelating agent is below about 2%, by weight.

7. A bleaching detergent composition comprising:

(a) from about 5 to 50%, by weight, of a bleaching agent comprising monoperoxyphthalic acid and/or a water-soluble salt thereof, said bleaching agent being devoid of an inorganic peroxygen compound;

(b) less than about 5%, by weight, of a chelating agent consisting essentially of diethylene triamine pentamethylene phosphonic acid (DTPMP) and/or a water-soluble salt thereof;

(c) from about 5 to 50%, by weight, of one or more detergent surface active agents selected from the group consisting of anionic, cationic, nonionic, ampholytic and zwitterionic detergents;

(d) from 5 to 80%, by weight, of a detergent builder salt selected from the group consisting of inorganic builders, carboxylates, polycarboxylates, polyhydroxysulfonates, salts of ethane 1-hydroxy-1,1-diphosphonic acid and ethane-1,1,2-triphosphonic acid and mixtures thereof; and (e) the balance comprising water and optionally a filler salt.

8. A bleaching detergent composition in accordance with claim 7 wherein said bleaching agent comprises magnesium monoperoxyphthalate.

9. A composition in accordance with claim 7 wherein the weight ratio of chelating agent to monoperoxyphthalic acid and/or its salt is from about 1:5 to about 1:50.

10. A bleaching detergent composition in accordance with claim 7 wherein the concentration of the chelating agent is below about 2%, by weight.

11. A process for bleaching which comprises contacting the stained and/or soiled material to be bleached with an aqueous solution of a composition comprising:

(a) from about 5 to 50%, by weight, of a bleaching agent comprising monoperoxyphthalic acid and/or a water-soluble salt thereof, said bleaching agent being devoid of an inorganic peroxygen compound;

(b) less than about 5%, by weight, of a chelating agent consisting essentially of diethylene triamine pentamethylene phosphonic acid (DTPMP) and/or a water-soluble salt thereof;

(c) from about 5 to 50%, by weight, of one or more detergent surface active agents selected from the group consisting of anionic, cationic, nonionic, ampholytic and zwitterionic detergents;

(d) from about 5 to 80%, by weight, of a detergent builder salt selected from the group consisting of inorganic builders, carboxylates, polycarboxylates, polyhydroxysulfonates, salts of ethane 1-hydroxy-1,1-diphosphonic acid and ethane-1,1,2-triphosphonic acid and mixtures thereof; and (e) the balance comprising water and optionally a filler salt.

12. A process in accordance with claim 11 wherein said composition contains magnesium monoperoxyphthalate.

13. A process in accordance with claim 11 wherein the chelating agent is present in a weight ratio relative to monoperoxyphthalic acid and/or its salt from about 1:5 to about 1:50.

14. A process in accordance with claim 11 wherein said weight ratio is from about 1:7 to about 1:20.

15. A process in accordance with claim 11 wherein said composition additionally contains one or more surface active detergents selected from the group consisting of anionic, cationic, nonionic, ampholytic and zwitterionic detergents.

16. A process for manufacturing the composition of claim 7 which comprises:

(a) forming an aqueous slurry containing said detergent surface active agent(s) and said builder salts;

(b) spray-drying said aqueous slurry to form granular particles thereof; and (c) adding to the granular particles formed in step (b) the composition comprising monoperoxyphthalic acid and/or a water-soluble thereof and a chelating agent consisting essentially of diethylene triamine pentamethylene phosphonic acid and/or a water-soluble salt thereof.

* * * * *